US006286731B1

(12) United States Patent
Lillelund et al.

(10) Patent No.: US 6,286,731 B1
(45) Date of Patent: Sep. 11, 2001

(54) SEALED DISPENSING CONTAINER

(75) Inventors: Stig Lillelund, Gentofte; Jakob Heiberg, Charlottenlund; Ian Tomas Benzon, Kobenhavn, all of (DK); Robert H. C. M. Daenen, Herne (BE)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 09/506,127

(22) Filed: Feb. 17, 2000

(51) Int. Cl.[7] ..... B65D 47/00
(52) U.S. Cl. ..... 222/480; 222/481; 222/556
(58) Field of Search ..... 222/480, 478, 222/481, 556

(56) References Cited

U.S. PATENT DOCUMENTS

| | | | | |
|---|---|---|---|---|
| D. 155,564 | | 10/1949 | Ackerman | D9/503 |
| D. 267,387 | | 12/1982 | Koch | D9/503 |
| D. 323,766 | | 2/1992 | Robbins | D9/503 |
| D. 328,248 | | 7/1992 | Ruff | D9/503 |
| D. 337,052 | | 7/1993 | Anderson | D9/503 |
| D. 347,769 | | 6/1994 | Kibbe | D9/503 |
| D. 381,582 | | 7/1997 | Bolton | D9/503 |
| 1,208,189 | * | 12/1916 | Miller | 222/480 |
| 2,162,853 | | 6/1939 | Massey | D9/503 |
| 2,269,201 | | 1/1942 | Hokerk | D9/503 |
| 2,654,485 | | 10/1953 | Bishop et al. | D9/503 |
| 2,696,943 | | 12/1954 | Stevens | D9/503 |
| 2,764,309 | | 9/1956 | Zelonka | D9/503 |
| 2,986,309 | * | 5/1961 | Larson | 222/480 |
| 3,036,746 | * | 5/1962 | Hagen | 222/480 |
| 3,323,683 | * | 6/1967 | Cianciolo | 222/480 |
| 3,731,792 | | 5/1973 | Rolston | D9/503 |
| 5,203,492 | | 4/1993 | Schellenberg | D9/503 |
| 5,219,100 | * | 6/1993 | Beck et al. | 222/480 |
| 5,258,086 | | 11/1993 | Hale | D9/503 |
| 5,975,368 | * | 11/1999 | Wood | 222/480 |

* cited by examiner

*Primary Examiner*—Kevin Shaver
*Assistant Examiner*—Stephanie Willatt
(74) *Attorney, Agent, or Firm*—Taylor J. Ross

(57) ABSTRACT

A sealed dispensing container having a container body 12, bottom seal 14, cover 16 and cap 18. The container body 12 is open at the bottom, and is closed by the bottom seal 14. This permits easy refilling of contents, as well as an additional dispensing point. A plurality of dispensing areas 30 are formed on container body 12, and includes dispensing apertures 32 of differing sizes. The cover 16 and cap 18 include dispenser grips 52 which secure them to the associated dispensing areas 30. The cap 18 is additionally pivoted to the container body 12 for opening and dispensing. The cover 16 and cap 18 may be repositioned, so that the cap 18 is associated with a different one of the dispensing areas 30.

4 Claims, 3 Drawing Sheets

SEALED DISPENSING CONTAINER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to containers for storing and dispensing particulate and flake material, such as spices used in household cooking. In particular, the present invention relates to an improved container of this type, which permits a choice in dispensing hole size, is simple to operate, provides excellent moisture resistance, and ensures a complete product cycle.

Numerous containers are known for storing and dispensing dried spices in the home. In recent years, such containers have tended to be disposable upon depleting the contents. As this is not environmentally sound practice, it was desired to provide a storage and dispensing container which could be refilled, and thus reused indefinitely.

Reusable containers have of course been known. One potential drawback to such containers is that the stored product will not complete a product cycle. In other words, during refilling, the initial product remaining in the container is covered by the new product, and is thus not dispensed. This same condition continues with each subsequent refilling, such that the initial product remains trapped at the bottom of the container. This initial product will lose its freshness, providing poor results if and when used, or possibly contaminating the new product. To guard against this, it was desired to refill the container from the bottom, as is known in the art, forcing the initial product to the top and adjacent the dispensing mechanism. This arrangement is known, for example, from the TUPPERWARE® Premium Modular Mate. In the present container, however, it also serves as a further dispensing mechanism. Specifically, a removable bottom which permits refilling will also permit introduction of a measuring spoon.

It is also known to provide a dispensing storage container with an apertured lid and a separate cap to seal the aperture. U.S. Pat. No. 2,882,947 to Close is a good example of a standard pivoting arrangement. The container includes a lid with a raised aperture and a trunion spaced from the aperture. A cap is pivoted to the trunion, and may be placed in a position to seal the aperture about the cap's outer periphery. While this is a simple and efficient arrangement, the visible trunion is not aesthetically pleasing. U.S. Pat. No. 4,723,693 also shows a lid, but with two apertures. A cap mounts to the lid by press fit, and includes two flaps which pivot about living hinges to seal the apertures. This arrangement provides a more finished appearance, but the visible hinge lines again detract from the aesthetics. U.S. Pat. No. 5,415,312 shows this arrangement with two raised apertures in the lid, and the cap being a strip with rings to seal about the outer periphery of each aperture. The cap is flexible to permit it to be deformed to move from a position blocking the aperture. The seal of the cap to the raised apertures is the only mechanism retaining the cap. This arrangement is simple, but is not sufficiently secure for retaining the cap.

SUMMARY OF THE INVENTION

An object of the present invention is to provide a dispensing container which permits easy dispensing, yet securely stores the contents.

Another object of the present invention is to provide such a container with the ability to dispense a wide range of materials, from fine powders to flakes.

Yet another object is to provide such a container which is reusable, and which readily adapts to different contents.

These and other objects are achieved by a sealed dispensing container having a container body, bottom seal, cover and cap. The container body is open at the bottom, and is closed by the bottom seal. This permits easy refilling of contents, as well as an additional dispensing point. A plurality of dispensing areas are formed on container body, and includes dispensing apertures of differing sizes. The cover and cap include dispenser grips which secure them to the associated dispensing areas. The cap is additionally pivoted to the container body for opening and dispensing. The cover and cap may be repositioned, so that the cap is associated with a different one of the dispensing areas.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
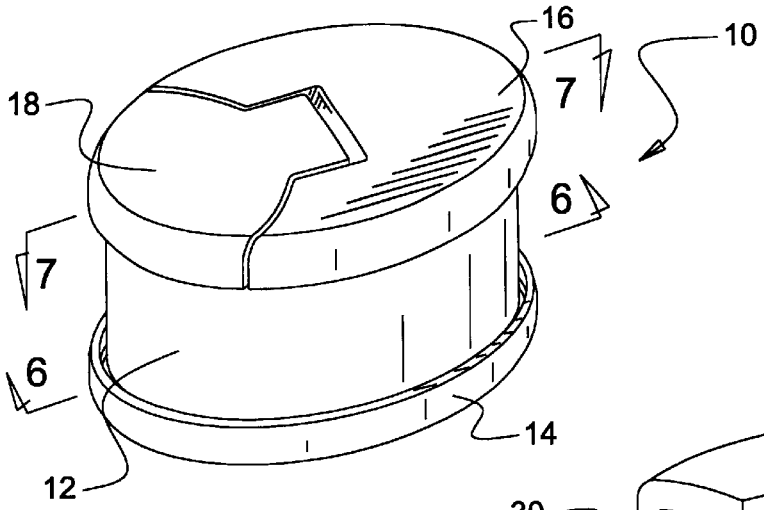
FIG. 1 is a perspective view of an assembled container according to the present invention.
Figure 2:
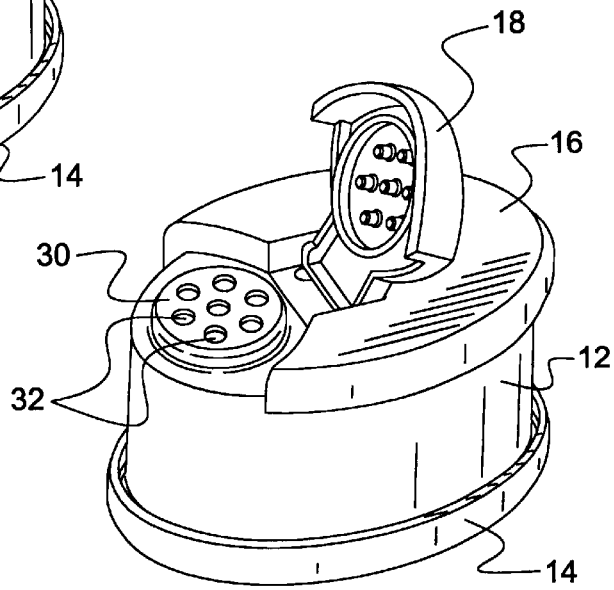
FIG. 2 is a perspective view of the assembled container of FIG. 1 with the cap in the open position for dispensing.

With reference to FIG. 1, a sealed dispensing container according to the present invention is generally designated by reference numeral 10. The container 10 generally includes a container body 12, a bottom seal 14, a cover 16, and at least one cap 18. These are assembled together in the configuration shown in FIGS. 1 and 2, as described more fully below.

Figure 3:
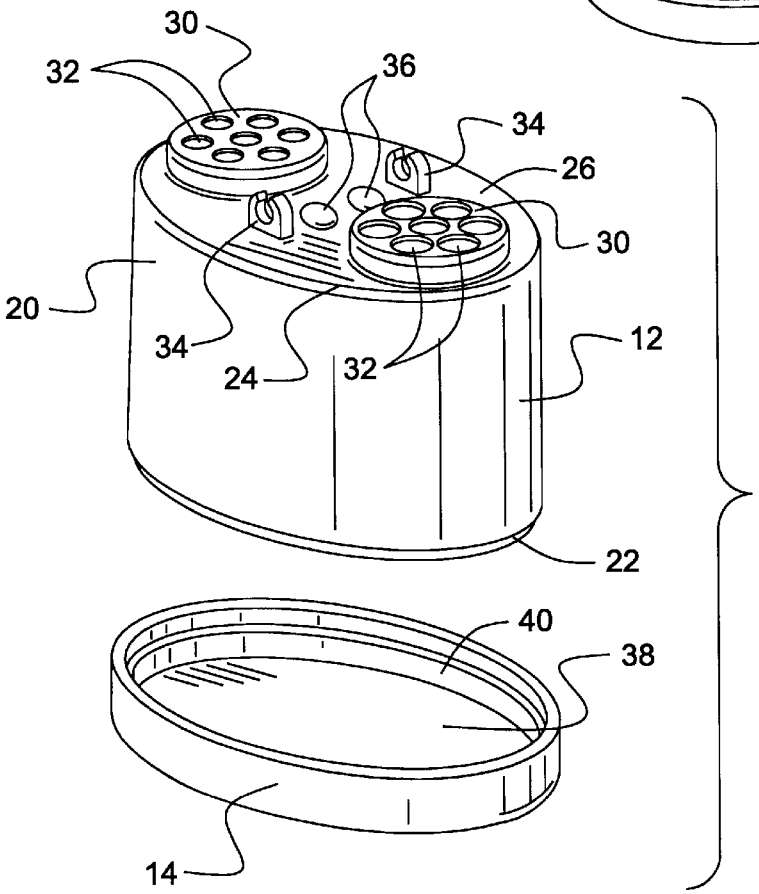
FIG. 3 is an exploded view of the container body and bottom seal.

With reference to FIG. 3, the container body 12 and bottom seal 14 are shown with the cover 16 and cap 18, removed for clarity. As may be seen, the container body 12 includes at least one side wall 20 extending from a lower rim 22 to an upper edge 24. In the embodiment shown, there is a single side wall 20 having an elliptical shape. Other shapes are of course possible. A top wall 26 is fixed to the upper edge 24, and is preferably a monolithic extension of the side wall 20. The side wall 20 and top wall 26 together define an interior 28 (FIG. 6) fully accessible via the opening created by the lower rim 22.

Additionally, the top wall 26 includes at least two raised dispensing areas 30. It is preferred that the dispensing areas 30 have a substantially identical shape and size for interchangeability with the cap 18. In the embodiment shown, the dispensing areas 30 are circular, but other shapes could be employed. Each of the dispensing areas 30 have at least one dispensing aperture 32 extending therethrough and providing access to the interior 28. While a single dispensing aperture 32 could be provided in one or both of the dispensing areas 30, it is preferred that both dispensing areas 30 include a plurality of the dispensing apertures 32. Further, it is preferred that the dispensing aperture 32 vary in size between the different dispensing areas 30. As an example, in FIG. 3 the leftmost dispensing area 30 includes circular dispensing apertures 32 of a diameter smaller than those of the rightmost dispensing area 30. These are most preferably sized for powdered and flake (leaf) spices, respectively.

The top wall 26 also includes at least one pair of trunions 34 for mounting cap 18 in a manner described more fully below. In the embodiment shown, with two dispensing areas 30, the trunions 34 are mounted between the dispensing areas 30 (specifically, the axis of trunions 34 is perpendicular to, an intersects the midpoint of, a line extending between the centers of the dispensing areas 30). The top wall 26 may also include at least one abutment stop 36 located adjacent the trunions 34.

Figure 7:
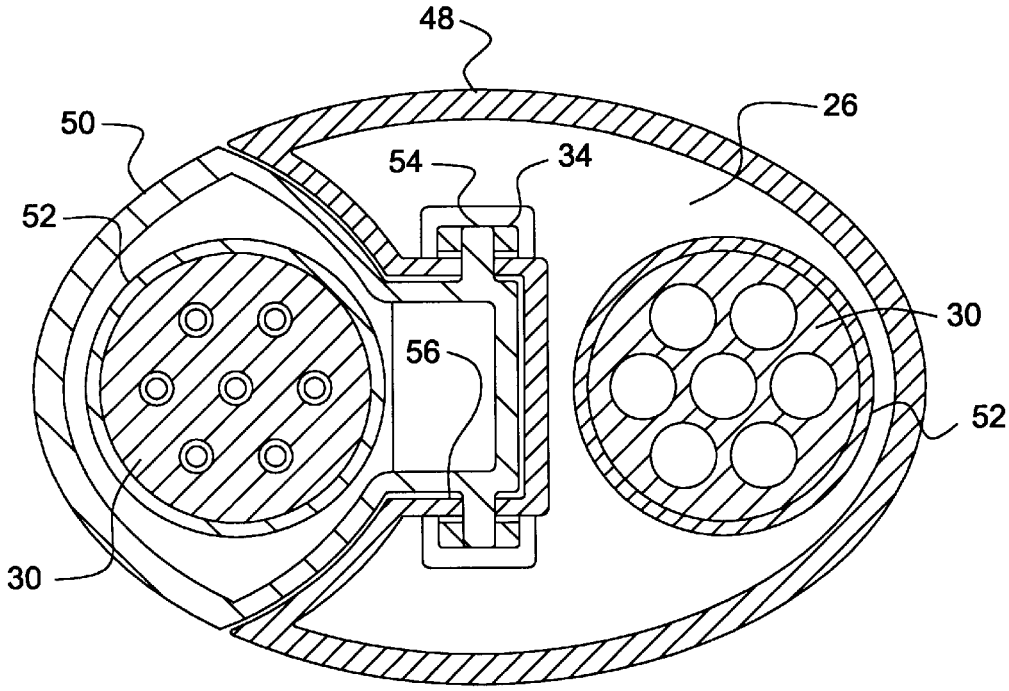
FIG. 7 is a cross-sectional view along line 7—7 of FIG. 1.

The bottom seal 14 includes a main panel 38 having a peripheral shape and size similar to that of lower rim 22. Extending from this main panel 38 is a seal skirt 40 sized to frictionally engage the lower rim 22, either on the outer or inner face of the side wall 20. In the embodiment show, the outer face is engaged. This is preferred to allow the user to use the seal skirt 40 for manual pressing to remove the bottom seal 14 from container body 12. The lower rim 22 and seal skirt 40 may, and preferably do, include a mating rib and groove 42 (best shown in FIG. 7) to increase the reliability of the seal, which is preferably water and moisture-tight.

Figure 4:
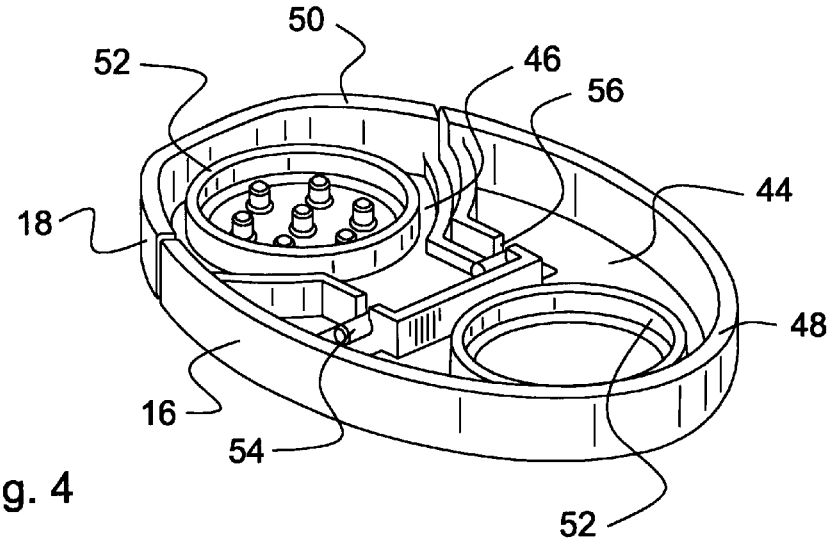
FIG. 4 is a bottom rear perspective view of the cover and cap removed from the container body.
Figure 5:
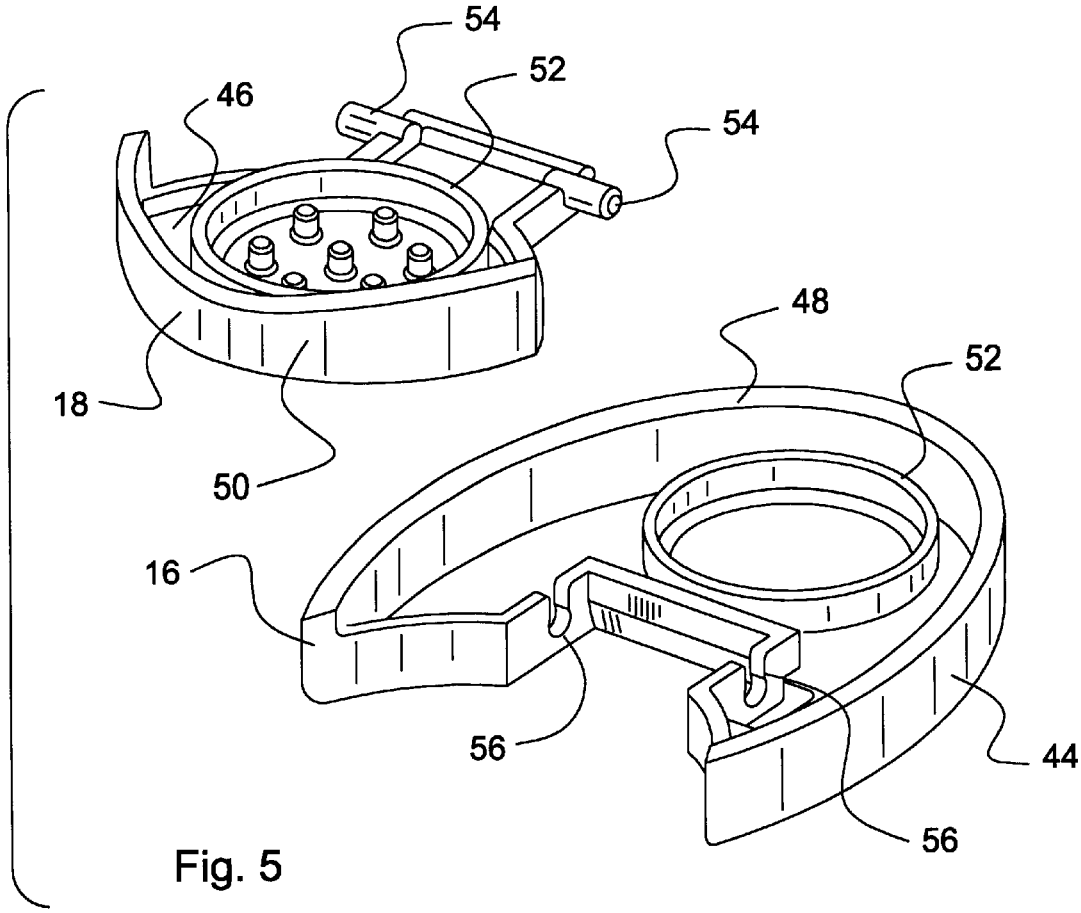
FIG. 5 is an exploded bottom front perspective view the cover and cap of FIG. 4.

As shown in FIG. 1, the cover 16 and cap 18, when in the assembled and closed positions shown, fit together to resemble a single common lid for the container 10. In particular, with reference to FIGS. 4 and 5, the cover 16 includes a cover panel 44, and each cap 18 includes a cap panel 46. A portion (preferably the majority) of the periphery of the cover panel 44 is sized and shaped similarly to upper edge 24, and from this portion preferably extends a cover skirt 48. Similarly, a portion of the periphery of the cap panel 46 is sized and shaped similarly to the remaining portion of upper edge 24, and from this portion preferably extends a cap skirt 50.

As may be seen, the cover skirt 48 and cap skirt 50 (if it is employed) resemble a continuous skirt extending from the respective cover 16 and cap 18. While not required, this provides a smooth, finished appearance to the container 10, as shown in FIG. 1. Similarly, the portions of the cover panel 44 and cap panel 46 which do not include the skirts are preferably formed with a mating peripheral shape. This arrangement, again while not required, provides a smooth, continuous appearance for the container 10.

The cover 16 and cap 18 must of course be secured to the container body 12. To this end, each is provided with a dispenser grip 52. In particular, each cap 18 is provided with one dispenser grip 52, and the cover 16 is provided with at least one dispenser grip 52. The dispenser grips 52 extend downward from the cap panel 46 and cover panel 44, respectively. In the embodiment shown, they take the form of a periphery of a closed geometric shape, corresponding to the outer periphery of the associated dispensing area 30. In other words, the dispenser grip 52 is an extension sized and shaped to closely surround, and grip, the associated dispensing area 30 . While the dispenser grip 52 could be interrupted to form a plurality of gripping fingers (not shown), it is preferred to employ the continuous form shown, as this will provide the greatest seal with the dispensing areas 30, helping to ensure freshness of the container contents.

Figure 6:
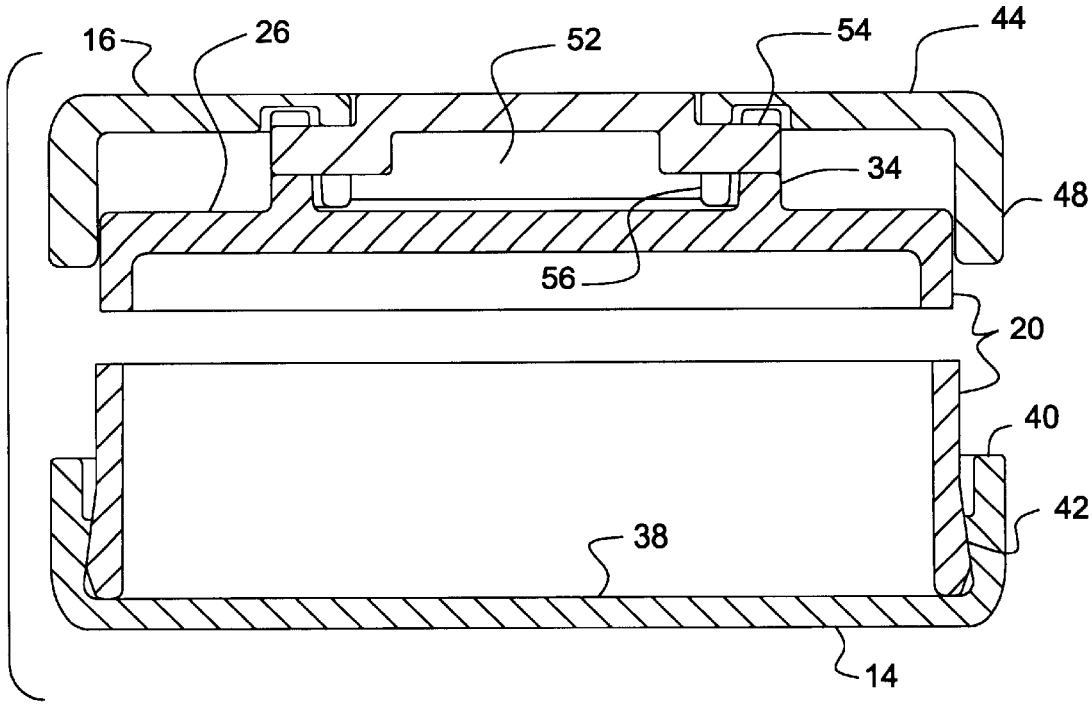
FIG. 6 is a cross-sectional detail view along line 6—6 of FIG. 1.

It is primarily this dispenser grip 52 which the cover 16 to the container body 12. As best shown in FIG. 6, if the cover skirt 48 is employed, it may be slightly spaced from the side wall 20. Since the cover skirt 48 is not continuous about the side wall 20, it could not provide a sufficiently secure attachment of the cover 16 to the container body 12. The provision of the dispenser grip 52 thus permits the non-continuous form of the cover skirt 48 (or the complete lack of a cover skirt 48, if desired).

In the embodiment shown, the cover 16 overlies only one dispensing area 30. If the cover 16 overlies more than one dispensing area 30, a like number of dispenser grips 52 will be provided to thus seal each of the dispensing areas 30. While the fit is designed to permit a good seal, it will still permit simple manual attachment and removal of the dispenser grip 52 on the dispensing area(s) 30.

In a similar manner, the dispenser grip 52 for cap 18 extends from the cap panel 46 to grip and seal the associated dispensing area 30 underlying the cap 18. This will again serve to secure the cap 18 to the container body 12, when the cap 18 is in the closed position of FIG. 1. The cap 18 is also intended to be opened for dispensing of the container contents. To prevent the loss of the cap, it is pivotally attached to the container body 12.

Specifically, the cap includes a pair of pivot rods 54 positioned and sized to fit within the trunions 34. As may be envisioned, once the dispenser grip 52 has been manually released from the associated dispensing area 30, the cap 18 may pivot upward to the open position of FIG. 2 by rotation of the pivot rods 54 within the trunions 34, with this connection also serving to retain the cap 18 to the container body 12. If desired, the cap 18 may extend slightly beyond the pivot rods 54, such that the cap abuts the abutment stops 36 when in the open position. This will retain the cap 18 in the open position without user intervention.

To provide an even more secure retention of the cap 18, the cover 16 may include a pair of cover trunions 56 extending from the cover panel 44 and positioned to lie adjacent the trunions 34. By forming the pivot rods 54 of an appropriate length, the pivot rods 54 may also be secured within the cover trunions 56. This will also serve to provide additional retention of the cover 16 to the container body 12.

As is apparent from FIG. 1, this arrangement may provide a very smooth, sleek and finished appearance for the container 10. This smooth appearance provides a functional advantage in that the large flat surface which may be formed provides a stable support surface when the container 10 is inverted to refill contents. Additionally, the cap 18 forms a portion of the periphery, so that it is readily accessible for application of manual pressure for opening. There are no portions of the cover 16 to obstruct this operation. Beyond this, the described arrangement provides the ability to vary dispensing methods in the long term, but not lead to confusion in the short term.

Specifically, different types of contents have different preferred dispensing. For example, fine powders are typically preferred to be dispensed from relatively small dispensing apertures 32, while flake material is typically preferred to be dispensed from relatively large dispensing apertures 32. It is not that common for a user to desire to use both types of dispensing aperture 32 for a single type of contents. The prior art arrangement of providing caps for both types of apertures can thus lead to confusion as to which cap is associated with which aperture size, and thus result in the user opening the wrong cap.

In the present invention the cap may be associated with the desired aperture size, while the cover closes the infrequently used aperture size. This greatly eliminates the confusion. As noted above, more than two dispensing areas 30 may be provide, and more than one cap 18 may be provided as well. Even with this arrangement, at least one of the dispensing areas 30 will be hidden beneath the cover 16, again reducing confusion.

This does not reduce the utility of the present device, however. In particular, the dispensing areas 30 and trunions 34 are placed such that the positions of the cover 16 and cap 18 may be altered. For example, the placement of the cover 16 and cap 18 in FIG. 1 may be rotated 180 degrees about a vertical axis, such that the cap is associated with the other of the illustrated two dispensing areas 30. Other geometric configurations will of course be apparent to those in the art, such as a triangular arrangement of three dispensing areas 30, a square, rectangular or parallelepiped configuration with four dispensing areas 30, and so on. This arrangement permits the container 10 to thus be a permanent, rather than disposable, appliance, and to have use with a wide variety of different contents. To the end the ability to remove the bottom seal 14 provides increased convenience for refilling with the same or different contents.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A sealed dispensing container, including at least one side wall having an upper edge and a lower rim, a bottom seal secured to said lower rim, a top wall secured to said upper edge, said side wall, bottom seal and top wall together defining an interior of said container, at least one pair of trunions mounted upon said top wall and a cap having pivot rods pivotally mounted to said pair of trunions to permit movement between a closed and an open position, the improvement comprising:

at least two dispensing areas being secured to said top wall, each of said dispensing areas being raised with respect to said top wall, and each of said dispensing areas including a plurality of dispensing apertures extending therethrough, said cap including a dispenser grip frictionally surrounding a first of said dispensing areas when said cap is in said closed position, and further comprising a cover having a dispenser grip frictionally surrounding a second of said dispensing areas to thus secure said cover to said top wall, said cover including a pair of cover trunions engaged upon said pivot rods.

2. A container as in claim 1, wherein said cap, in said closed position, and said cover together define a substantially continuous surface.

3. A container as in claim 2, wherein said bottom seal includes a seal skirt frictionally retained to said lower rim.

4. A container as in claim 1, wherein said at least two dispensing areas comprise two dispensing areas, and said at least one pair of trunions comprise one pair of trunions mounted upon said top wall, said one pair of trunions being mounted at a mid-point between said dispensing areas such that said cap may be selectively mounted to said trunions for operation with either said first or said second dispensing area.

* * * * *